US007267916B2

(12) United States Patent
Sugino et al.

(10) Patent No.: US 7,267,916 B2
(45) **Date of Patent: *Sep. 11, 2007**

(54) ELECTROPHOTOGRAPHIC PHOTORECEPTOR, AND IMAGE FORMING METHOD, IMAGE FORMING APPARATUS AND PROCESS CARTRIDGE THEREFOR USING THE ELECTROPHOTOGRAPHIC PHOTORECEPTOR

(75) Inventors: Akihiro Sugino, Numazu (JP); Shinji Nousho, Numazu (JP); Takaaki Ikegami, Susono (JP); Eiji Kurimoto, Numazu (JP); Hideo Nakamori, Numazu (JP); Hidetoshi Kami, Numazu (JP); Yasuyuki Yamashita, Numazu (JP)

(73) Assignee: Ricoh Company, Ltd., Tokyo (JP)

( * ) Notice: Subject to any disclaimer, the term of this patent is extended or adjusted under 35 U.S.C. 154(b) by 253 days.

This patent is subject to a terminal disclaimer.

(21) Appl. No.: 10/893,302

(22) Filed: Jul. 19, 2004

(65) Prior Publication Data

US 2005/0053853 A1 Mar. 10, 2005

(30) Foreign Application Priority Data

Jul. 17, 2003 (JP) ..... 2003-198801
Jul. 28, 2003 (JP) ..... 2003-202507

(51) Int. Cl.
*G03G 5/147* (2006.01)

(52) U.S. Cl. ..... 430/66; 430/58.05; 430/124; 399/111; 399/159

(58) Field of Classification Search ..... 430/66, 430/58.05, 124; 399/159, 111
See application file for complete search history.

(56) References Cited

U.S. PATENT DOCUMENTS 4,663,259 A * 5/1987 Fujimura et al. ..... 430/59.6
4,792,507 A * 12/1988 Yoshihara et al. ..... 430/59.6
4,957,839 A 9/1990 Rokutanzono et al.
5,008,172 A 4/1991 Rokutanzono et al.
5,147,751 A 9/1992 Kojima et al.
5,342,718 A 8/1994 Nousho et al.
5,578,405 A 11/1996 Ikegami et al.
5,667,926 A * 9/1997 Maruyama et al. ..... 430/97
5,702,855 A 12/1997 Ikegami et al.
5,871,876 A 2/1999 Ikuno et al.
5,991,573 A 11/1999 Nohsho et al.
6,030,733 A 2/2000 Kami et al.
6,030,736 A 2/2000 Ikegami et al.
6,151,468 A 11/2000 Kami et al.
6,326,111 B1 * 12/2001 Chambers et al. ..... 430/58.05
6,326,112 B1 12/2001 Tamura et al.
6,432,596 B2 8/2002 Ikuno et al.
6,573,016 B2 6/2003 Kami et al.
6,618,565 B2 9/2003 Tamiya et al.
6,641,964 B2 11/2003 Ikuno et al.
6,653,033 B1 11/2003 Kami et al.
6,777,149 B2 8/2004 Ikegami et al.
6,777,150 B2 8/2004 Suzuki et al.
6,781,821 B2 8/2004 Tsubai
6,785,500 B2 8/2004 Takahashi et al.
6,790,572 B2 9/2004 Tamoto et al.
2003/0002078 A1 1/2003 Toda et al.
2003/0035661 A1 2/2003 Kabata et al.
2003/0077531 A1 4/2003 Suzuki et al.
2003/0113642 A1 6/2003 Kami et al.
2003/0118359 A1 6/2003 Ogiyama et al.
2003/0129512 A1 7/2003 Sugino et al.
2003/0194627 A1 10/2003 Ikegami et al.
2003/0206226 A1 11/2003 Kurimoto et al.
2003/0215726 A1 11/2003 Sugino et al.
2003/0219279 A1 11/2003 Nohsho et al.
2004/0028435 A1 2/2004 Kurimoto et al.
2004/0048178 A1 3/2004 Ikuno et al.
2004/0105692 A1 6/2004 Tamiya et al.

FOREIGN PATENT DOCUMENTS

JP 56-142567 11/1981
JP 58-102949 6/1983
JP 63-249152 10/1988
JP 6-130711 5/1994
JP 6-332219 12/1994
JP 8-179543 7/1996
JP 10-333363 12/1998
JP 11-338-307 12/1999

(Continued)

OTHER PUBLICATIONS

U.S. Appl. No. 10/184,904, filed Jul. 1, 2002, Toda et al.

(Continued)

*Primary Examiner*—Christopher Rodee
(74) *Attorney, Agent, or Firm*—Oblon, Spivak, McClelland, Maier & Neustadt, P.C.

(57) ABSTRACT

An electrophotographic photoreceptor including an electroconductive substrate and a photosensitive layer located overlying the electroconductive substrate, wherein an outermost layer of the electrophotographic photoreceptor includes a particulate fluorine-containing resin, and wherein a primary particle of the particulate fluorine-containing resin and a secondary particle formed of agglomerated primary particles thereof, which are projected from a surface of the outermost layer and have an average particle diameter of from 0.15 to 3 μm, are present in an area ratio not less than 10% based on total surface area of the outermost layer.

13 Claims, 5 Drawing Sheets

FOREIGN PATENT DOCUMENTS

| | | |
|---|---|---|
| JP | 2000-258928 | 9/2000 |
| JP | 2001-170465 | 6/2001 |
| JP | 2001-222130 | 8/2001 |
| JP | 2002-082464 | 3/2002 |
| JP | 2003-015326 | 1/2003 |
| JP | 2003-021920 | 1/2003 |
| JP | 2003-195537 | 7/2003 |

OTHER PUBLICATIONS

U.S. Appl. No. 10/103,791, filed Mar. 25, 2002, Suzuki et al.
U.S. Appl. No. 10/135,548, filed May 1, 2002, Kami et al.
U.S. Appl. No. 10/151,109, filed May 21, 2002, Kabata et al.
U.S. Appl. No. 10/180,316, filed Jun. 27, 2002, Sugino et al.
U.S. Appl. No. 10/235,961, filed Sep. 6, 2002, Ikegami et al.
U.S. Appl. No. 10/282,039, filed Oct. 29, 2002, Ogiyama et al.
U.S. Appl. No. 10/315,935, filed Dec. 11, 2002, Kurimoto et al.
U.S. Appl. No. 10/384,662, filed Mar. 11, 2003, Sugino et al.
U.S. Appl. No. 10/384,701, filed Mar. 11, 2003, Nohsho et al.
U.S. Appl. No. 10/628,532, filed Jul. 29, 2003, Kurimoto et al.
U.S. Appl. No. 10/614,828, filed Jul. 9, 2003, Tamiya et al.
U.S. Appl. No. 10/638,637, filed Aug. 12, 2003, Ikuno et al.
U.S. Appl. No. 10/660,620, filed Sep. 12, 2003, Murakami et al.
U.S. Appl. No. 10/893,302, filed Jul. 19, 2004, Sugino et al.
U.S. Appl. No. 10/900,204, filed Jul. 28, 2004, Kami et al.
U.S. Appl. No. 10/938,585, filed Sep. 13, 2004, Ikegami et al.
U.S. Appl. No. 11/006,643, filed Dec. 8, 2004, Takada et al.
U.S. Appl. No. 11/016,708, filed Dec. 21, 2004, Kitajima et al.
U.S. Appl. No. 11/030,307, filed Jan. 7, 2005, Kami et al.
U.S. Appl. No. 11/007,784, filed Dec. 9, 2004, Kondo et al.
U.S. Appl. No. 11/224,984, filed Sep. 14, 2005, Nousho et al.
U.S. Appl. No. 11/317,302, filed Dec. 27, 2005, Takada et al.
U.S. Appl. No. 11/366,469, filed Mar. 3, 2006, Sugino et al.
U.S. Appl. No. 11/403,012, filed Apr. 13, 2006, Toda.
U.S. Appl. No. 11/487,573, filed Jul. 17, 2006, Nakamori.
U.S. Appl. No. 11/505,860, filed Aug. 8, 2006, Orito et al.
U.S. Appl. No. 11/500,532, filed Aug. 8, 2006, Toshine et al.
U.S. Appl. No. 11/561,983, filed Nov. 21, 2006, Sugino et al.
U.S. Appl. No. 11/563,710, filed Nov. 28, 2006, Inaba et al.
U.S. Appl. No. 11/616,523, filed Dec. 27, 2006, Fujiwara et al.
U.S. Appl. No. 11/519,098, filed Sep. 12, 2006, Toda et al.

* cited by examiner

ELECTROPHOTOGRAPHIC PHOTORECEPTOR, AND IMAGE FORMING METHOD, IMAGE FORMING APPARATUS AND PROCESS CARTRIDGE THEREFOR USING THE ELECTROPHOTOGRAPHIC PHOTORECEPTOR

BACKGROUND OF THE INVENTION

1. Field of the Invention

The present invention relates to an electrophotographic photoreceptor for use in copiers, electrostatic printings, printers, electrostatic recordings, etc.; and to an image forming apparatus, an image forming method, and a process cartridge for the image forming apparatus using the electrophotographic photoreceptor.

2. Discussion of the Background

In an image forming apparatus such as a copier, a printer, and a facsimile using an electrophotographic method, writing light modulated with image data is irradiated to a uniformly charged photoreceptor to form an electrostatic latent image thereon; and an image developer provides a toner to the electrostatic latent image to form a toner image thereon. Next, the image forming apparatus transfers the toner image onto a transfer sheet (recording paper) with a transferer, fixes the toner image on the transfer sheet upon application of heat and pressure with a fixer, and collects the toner remaining on the photoreceptor with a cleaner such as a cleaning blade.

In such an image forming apparatus using an electrophotographic method, a surface friction coefficient of the photoreceptor is decreased to prevent unnecessary toner from adhering thereto and produce images without background fouling. In addition, a photoreceptor having a small surface friction coefficient can extend its lifetime because the surface is less abraded.

Namely, one of the factors affecting the lifetime of the photoreceptor is an abrasion of a photosensitive layer thereof. When a certain amount of the photosensitive layer is abraded, electric properties of the photoreceptors change and the image forming process cannot properly be performed. The friction is made at all parts wherein the photoreceptor and other image formers, such as image developers and transferers, contact with each other in the above-mentioned image forming process. When the surface friction coefficient of a photoreceptor is decreased, the friction made thereat can be decreased and a lifetime of the photoreceptor can be extended.

Further, it is known that a transfer ratio of a toner image formed on a photoreceptor to a transfer sheet is improved when the surface friction coefficient of a photoreceptor is decreased. Namely, a vermiculate transfer can be prevented and an amount of a residual toner after transfer can be decreased; therefore an amount of a waste toner can be decreased.

Further, recently it is becoming apparent that a spheric toner formed by emulsion polymerization methods and suspension polymerization methods, etc., to comply with requirements for higher electrophotographic image quality, can effectively be cleaned when the surface friction coefficient of a photoreceptor is decreased.

Typically, a blade formed of urethane rubber, etc. is contacted to a photoreceptor in the counter direction of a rotation direction thereof to remove a residual toner thereon after transfer. However, the spheric toner dives under a contact part between the cleaning blade and photoreceptor and scrapes therethrough, resulting in poor cleaning. A photoreceptor having a low surface friction coefficient can prevent the spheric toner from scraping through the contact part between the cleaning blade and photoreceptor, and thus prevent poor cleaning.

As a method of forming the photoreceptor having a low surface friction coefficient, Japanese Laid-Open Patent Publication No. 56-142567 discloses an image forming apparatus equipped with a mechanism providing a lubricant to a surface of the photoreceptor, and which is practically used. However, an image forming apparatus equipped with such a mechanism around the photoreceptor inevitably becomes large and complicated, resulting in cost increase and complicated maintenance.

As another method of forming the photoreceptor having a low surface friction coefficient, Japanese Laid-Open Patent Publications Nos. 58-102949 and 63-249152 disclose a method of adding a lubricant into a surface layer of a photoreceptor so as to reduce a friction coefficient thereof.

Specific examples of the lubricant include resins, including a fluorine atom (hereinafter referred to as fluorocarbon resins) such as polytetrafluoroethylene, powders of spheric acrylic resins and polyethylene resins, powders of metal oxides such as silicon oxide and aluminium oxide and lubricative liquids such as silicone oil. Particularly, the fluorocarbon resin including a large amount of fluorine atoms effectively works as a lubricant because of having a noticeably small surface energy. The fluorocarbon resin is used as a crystalline particulate material, e.g., in a surface layer or a protective layer of a photoreceptor after dispersed in a binder resin such as an acrylic resin, a polyester resin, a polyurethane resin and a polycarbonate resin.

However, when the surface layer or protective layer of a photoreceptor includes comparatively a small amount of a particulate fluorocarbon resin, a surface friction coefficient of the photoreceptor gradually increases as images are repeatedly produced, although being low at the beginning. Therefore, to maintain a low surface friction coefficient, increasing an addition amount of the particulate fluorocarbon resin can be considered. However, the particulate fluorocarbon resin tends to agglutinate in a resin solution and is difficult to disperse therein.

Various methods of dispersing the particulate fluorocarbon resin have been studied. Japanese Laid-Open Patent Publication No. 6-130711 discloses a method of dispersing a particulate fluorocarbon resin preferably having a weight-average molecular weight of from 30,000 to 5,000,000 and a particle diameter of from 0.01 to 10 μm, and more preferably from 0.05 to 2.0 μm in a protective layer with a sand mill in an amount of from 5.0 to 70.0% by weight such that an average surface roughness of the protective layer is from 0.1 to 5.0 μm when roughness of 10 points thereof are measured. Japanese Laid-Open Patent Publication No. 6-332219 discloses a method of preparing a photoreceptor having a surface layer including a fluorocarbon resin powder pulverized and dispersed by crashing a fluorocarbon graft polymer and a solvent when discharged from plural small diameter orifices. Japanese Laid-Open Patent Publication No. 8-179543 discloses a method of preparing a photoreceptor having a surface layer including a particulate fluorocarbon resin dispersed with a sand mill after dispersed while passed through a narrow nozzle with a high pressure. Japanese Laid-Open Patent Publication No. 2000-258928 discloses a method of preparing an electrophotographic photoreceptor using a coating liquid therefor dispersed by discharging the coating liquid from a small diameter orifice into a cylinder having a larger diameter than the orifice.

However, any surface layers formed by these methods include comparatively a small amount of a particulate fluorocarbon resin, and insufficiently maintain their low friction coefficients for long periods. Even in the method disclosed in Japanese Laid-Open Patent Publication No. 6-130711, wherein a large amount of the particulate fluorocarbon resin is included in the surface layer, it is considered that the particulate fluorocarbon resin is difficult to finely disperse because of tending to agglutinate, although a particle diameter thereof after dispersed is not disclosed. When such a coating liquid as includes a large amount of the particulate fluorocarbon resin is coated on a photoreceptor to form a surface layer, the surface layer includes a lot of huge secondary agglomerated particles. Therefore, concavities and convexities of the surface layer become large or the particulate fluorocarbon resin is eccentrically-located therein. When the concavities and convexities of the surface layer become large, it is considered that poor cleaning or irregular toner images occurs. When the particulate fluorocarbon resin is eccentrically-located in the surface layer, the surface layer microscopically has a part having a high friction coefficient and a part having a low friction coefficient, and therefore it is considered that poor cleaning occurs as well. Further, when the secondary agglomerated particles of the particulate fluorocarbon resin are too large, a laser beam is scattered thereon, which causes an irregular latent image, and a shortage of light amount and a shortage of potential contrast, resulting in production of abnormal images.

As mentioned above, although a trial of reducing a surface friction coefficient of a photoreceptor to prevent production of abnormal images by using a particulate fluorocarbon resin is made, continuousness of a low surface friction coefficient, dispersibility of the particulate fluorocarbon resin, and downsizing of an image forming apparatus are not yet satisfactory.

Because of these reasons, a need exists for an electrophotographic photoreceptor maintaining a low surface friction coefficient, stably producing quality images, and remaining cleaned for long periods of time.

SUMMARY OF THE INVENTION

Accordingly, an object of the present invention is to provide a low-cost and heavy-duty electrophotographic photoreceptor maintaining a low surface friction coefficient, and stably producing quality images, and remaining cleaned for long periods of time.

Another object of the present invention is to provide an image forming method, an image forming apparatus, and a process cartridge therefor using the electrophotographic photoreceptor.

Briefly, these objects and other objects of the present invention as hereinafter will become more readily apparent can be attained by an electrophotographic photoreceptor including at least an electroconductive substrate; and a photosensitive layer overlying the electroconductive substrate, wherein an outermost layer of the electrophotographic photoreceptor includes a particulate fluorocarbon resin, and wherein a primary particle of the particulate fluorine-containing resin and a secondary particle formed of agglomerated primary particles thereof, which are projected from a surface of the outermost layer and have an average particle diameter of from 0.15 to 3 μm are present in an area ratio not less than 10% based on total surface area of the outermost layer.

These and other objects, features and advantages of the present invention will become apparent upon consideration of the following description of the preferred embodiments of the present invention taken in conjunction with the accompanying drawings.

BRIEF DESCRIPTION OF THE DRAWINGS

Various other objects, features, and attendant advantages of the present invention will be more fully appreciated as the same becomes better understood from the detailed description when considered in connection with the accompanying drawings, in which like reference characters designate like corresponding parts throughout, and wherein.

DETAILED DESCRIPTION OF THE INVENTION

Figure 1:
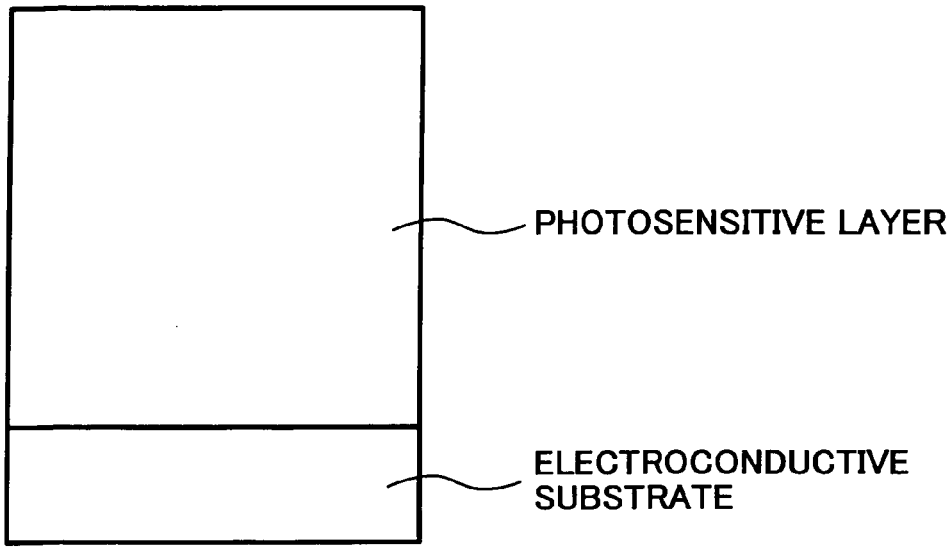
FIG. 1 is a cross-sectional view of an embodiment of layers of the electrophotographic photoreceptor of the present invention.

Generally, the present invention provides an electrophotographic photoreceptor producing good images without poor cleaning even after repeatedly used for long periods when the electrophotographic photoreceptor includes at least an electroconductive substrate; and a photosensitive layer overlying the electroconductive substrate, wherein an outermost layer of the electrophotographic photoreceptor includes a particulate fluorocarbon resin, and wherein a primary particle of the particulate fluorocarbon resin and a secondary particle formed of agglomerated primary particles thereof projected from a surface of the outermost layer and having an average particle diameter of from 0.15 to 3 μm are present in an area ratio not less than 10% based on total surface area of the outermost layer. The average particle diameter of the primary particle or the secondary particle is an average of inner diameters passing through a center of gravity of an image of the particle when measured at intervals of every angle of 2°.

The particulate fluorocarbon resin for use in the present invention tends to secondly agglutinate in a resin coating liquid because the particulate fluorocarbon resin is very fine and scarcely has affinity with a binder resin. Therefore, it is difficult to prepare a primary particle of the particulate fluorocarbon resin and a secondary particle formed of agglomerated primary particles thereof projected from a surface of the outermost layer and having an average particle diameter of from 0.15 to 3 μm present in an area ratio not less than 10% based on total surface area of the outermost layer by conventional coating liquid dispersion methods or nozzle and orifice spray coating dispersion methods.

Therefore, in the present invention, to prepare a coating liquid forming the coated layer without fail, a liquid including a fluorocarbon graft polymer, which is discharged from an orifice at high pressure, is collided with each other to perform a first dispersion, and secondly dispersed with a supersonic.

Further, the thus prepared coating liquid needs to be coated on a photoreceptor such that a particulate material does not settle down therein. For example, a spray coater wherein the coating liquid reaches a spray nozzle in comparatively a short time from a tank stirring the coating liquid needs to be used.

A coating liquid prepared by a dispersion with a ball mill or a sand mill using a medium and a dispersion colliding the coating liquid to a wall is not sufficiently dispersed, and the coated layer of the present invention cannot be prepared therewith. This is because the particulate fluorocarbon resin is comparatively soft, and tends to be deformed, bonded with itself, and agglutinate.

An electrophotographic photoreceptor having such an outermost layer has a very low surface friction coefficient, can maintain the low surface friction coefficient even after repeatedly used and good cleanability for long periods, and has very little abrasion and a high durability.

The exact reason for this is not clear, but the following reasons can be considered.

When the primary particle and secondary particle formed of agglomerated primary particles projected from a surface of the outermost layer and having an average particle diameter of from 0.15 to 3 μm are present in an area ratio less than 10% based on total surface area of the outermost layer, the following patterns can be considered.

1. The outermost layer includes a small amount of the particulate fluorocarbon resin.

2. Most of the particulate fluorocarbon resins projected from a surface of the outermost layer (including the secondary particle) have a particle diameter less than 0.15 μm.

3. Most of the particulate fluorocarbon resins projected from a surface of the outermost layer have a particle diameter greater than 3 μm.

When the outermost layer includes a small amount of the particulate fluorocarbon resin, as mentioned above, a low surface friction coefficient cannot be maintained after repeated use and it is probable that poor cleaning will occur before long.

When most of the particulate fluorocarbon resins projected from a surface of the outermost layer have a particle diameter less than 0.15 μm, the outermost layer does not have sufficiently a low friction coefficient and poor cleaning will occur. Namely, when a photoreceptor has a low friction coefficient, a toner slips well thereon and cleanability thereof improves. Therefore, when a contact area between the particulate fluorocarbon resin and a toner becomes small, the toner does not slip well on a surface of the photoreceptor, resulting in poor cleaning.

When most of the particulate fluorocarbon resins projected from a surface of the outermost layer have a particle diameter greater than 3 μm, as mentioned above, the outermost layer has large surface roughness, resulting in poor cleaning, deterioration of sharpness of an electrostatic latent image due to scattered laser beams and production of abnormal images due to reduction of potential contrast.

Accordingly, in the present invention, it is essential that a primary particle of the particulate fluorocarbon resin and a secondary particle formed of agglomerated primary particles thereof projected from a surface of the outermost layer and having an average particle diameter of from 0.15 to 3 μm are present in an area ratio not less than 10% based on total surface area of the outermost layer.

Further, in the present invention, the primary particle of the particulate fluorocarbon resin and secondary particle formed of agglomerated primary particles thereof projected from a surface of the outermost layer and preferably having an average particle diameter of from 0.2 to 1.5 μm are present in an area ratio not less than 10% based on total surface area of the outermost layer.

A photoreceptor satisfying the above-mentioned conditions has a surface having more uniformly a low friction coefficient and less roughness.

Further, in the present invention, the outermost layer preferably includes the particulate fluorocarbon resin in an amount of 20 to 60% by volume.

When the outermost layer includes the particulate fluorocarbon resin in an amount of 20 to 60% by volume and the secondary particle is not eccentrically located in the outermost layer, even though the outermost layer is abraded, the secondary particles present therein project from the surface thereof one after another such that an area ratio of the secondary particles is in a preferable range. In addition, the outermost layer has a preferable mechanical strength and deterioration of an abrasion resistance thereof is prevented because the particulate fluorocarbon resins are not present than necessary.

Further, in the present invention, the photosensitive layer preferably includes a layer including at least a charge generation material and a charge transport material, and a protective layer including at least a binder resin and a particulate fluorocarbon resin. Such a functionally-separated electrophotographic photoreceptor as has a photosensitive layer working as a photoreceptor and a protective layer having a low friction coefficient has a good friction coefficient and a good abrasion resistance.

Further, in the present invention, the outermost layer preferably includes at least a charge transport material.

Particularly when the protective layer is the outermost layer, the protective layer including a charge transport material makes a charge smoothly transport to prevent an increase of residual potential.

Further, in the present invention, an image forming apparatus and an image forming method using the electrophotographic photoreceptor of the present invention, a charger and a transferer are provided. Even though a spheric toner is used in such an image forming apparatus and an image forming method, poor cleaning is difficult to occur, and even though a laser having a short wavelength therein, abnormal images are difficult to produce and good images are produced for long periods.

In addition, in the present invention, an image forming apparatus equipped with a contactor contacting and frictionizing a surface of the electrophotographic photoreceptor of the present invention is provided.

In such an image forming apparatus, the electrophotographic photoreceptor having a low friction coefficient of the present invention more effectively works, i.e., cleanability and abrasion resistance thereof noticeably increase. A reason for this effect is not clear yet, but the following mechanisms can be considered.

When the contactor frictionizes the outermost layer the electrophotographic photoreceptor, from which the particulate fluorocarbon resin is projected, the projected part thereof is expanded in the frictionizing direction to coat a surface of the electrophotographic photoreceptor, on which the particulate fluorocarbon resin is not present. The outermost layer of the electrophotographic photoreceptor of the present invention includes the particulate fluorocarbon resin having a preferable size almost uniformly in a preferable range, and therefore, almost all surface of the electrophotographic photoreceptor can be coated with the particulate fluorocarbon resin without increasing the particulate fluorocarbon resin, i.e., almost all surface thereof uniformly has a low friction coefficient. Further, even when the outermost layer is abraded, the particulate fluorocarbon resin present therein separates out and a low friction coefficient thereof can be maintained for long periods, i.e., high cleanability and abrasion resistance of the electrophotographic photoreceptor can be maintained.

A frictionized surface of the photoreceptor is actually observed with a SEM to find the particulate fluorocarbon resin coating the surface as mentioned above.

In addition, in the present invention, there is provided a tandem-type image forming apparatus and a tandem-type image forming method using at least plural electrophotographic photoreceptors of the present invention, chargers, irradiators, and transferers.

Such a tandem-type image forming apparatus and a tandem-type image forming method can produce good full-color images at a very high speed.

Further, in the present invention, there is provided an image forming apparatus firstly transferring a toner image developed on the electrophotographic photoreceptor of the present invention onto an intermediate transferer and secondly transferring the toner image on the intermediate transferer onto a recording material, wherein plural color toner images are sequentially overlapped on the intermediate transferer and the color toner images are transferred onto the receiving material at a timer to produce good images with less color drift. Further, a layout in the image forming apparatus can more freely be designed with the intermediate transferer to downsize the apparatus and simplify maintenance thereof.

In addition, in the present invention, there is provided a process cartridge for an image forming apparatus, equipped with at least one of a charger, an irradiator, an image developer, and a transferer, besides the electrophotographic photoreceptor of the present invention.

The process cartridge can easily replace an electrophotographic photoreceptor and other members in a short time, i.e., a time for maintenance can be shortened, resulting in cost reduction. In addition, the process cartridge has an advantage of being more precisely fitted in an apparatus because of including the electrophotographic photoreceptor and other members are in a body.

Next, the present invention will be explained further in detail according to the drawings.

Figure 2:
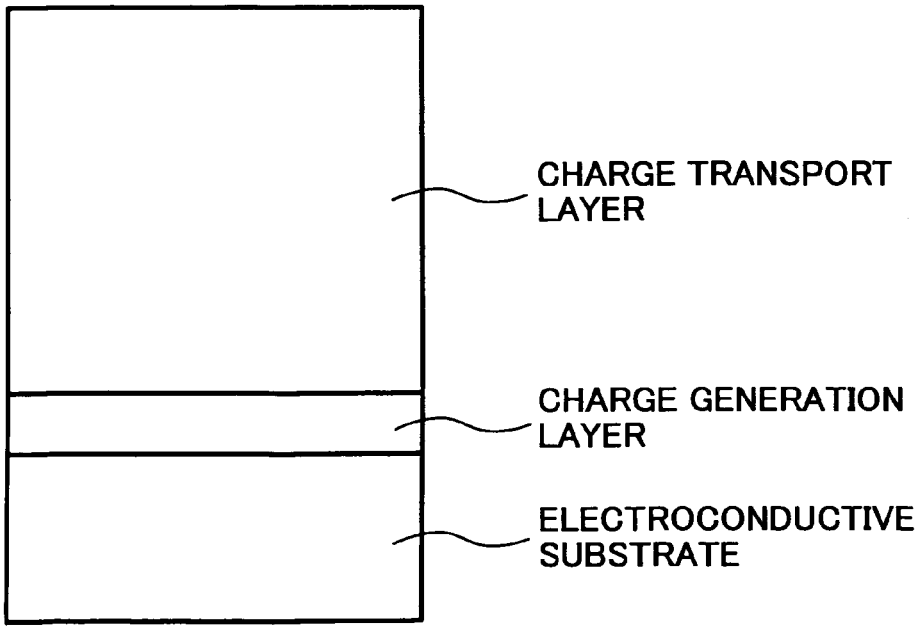
FIG. 2 is a cross-sectional view of another embodiment of layers of the electrophotographic photoreceptor of the present invention.
Figure 3:
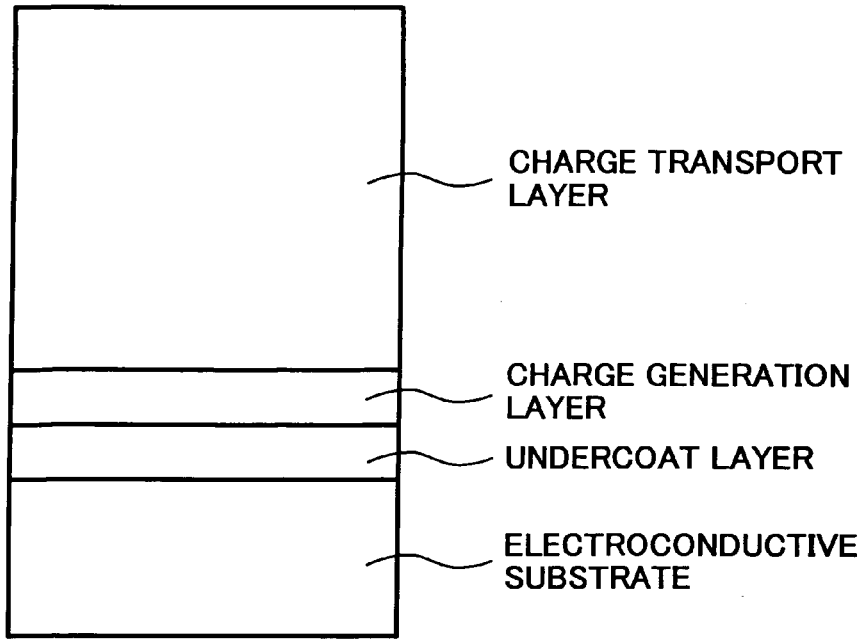
FIG. 3 is a cross-sectional view of a third embodiment of layers of the electrophotographic photoreceptor of the present invention.
Figure 4:
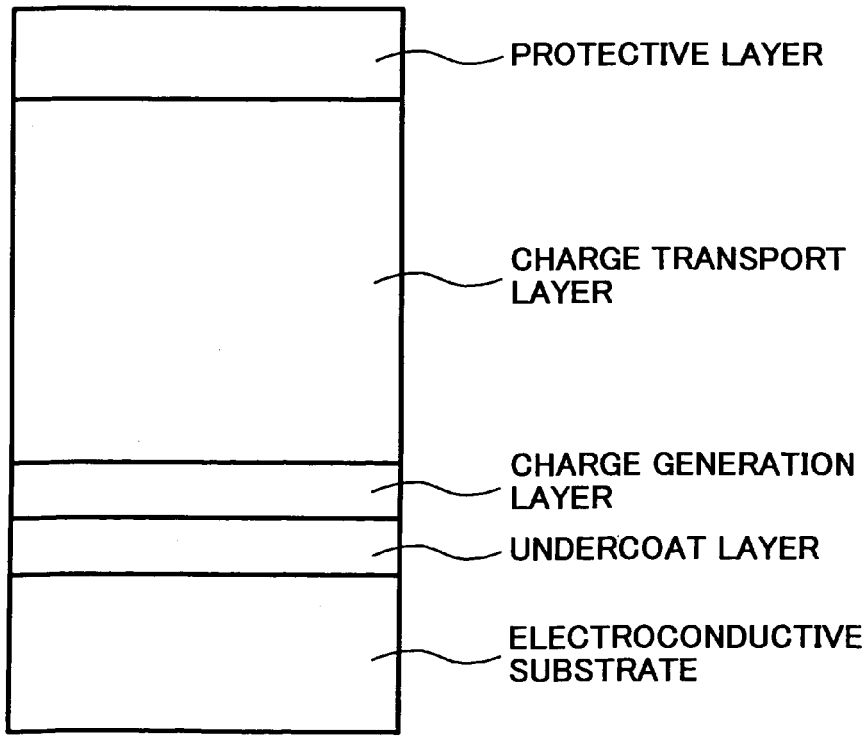
FIG. 4 is a cross-sectional view of a fourth embodiment of layers of the electrophotographic photoreceptor of the present invention.

FIG. 1 is a cross-sectional view of an embodiment of layers of the electrophotographic photoreceptor of the present invention, wherein a photosensitive layer is formed on an electroconductive substrate. FIGS. 2 to 4 are respectively cross-sectional views of other embodiments of layers of the electrophotographic photoreceptor of the present invention. FIG. 2 represents a functionally-separated electrophotographic photoreceptor including a photosensitive layer formed of a charge generation layer (CGL) and a charge transport layer (CTL). FIG. 3 represents a functionally-separated electrophotographic photoreceptor including an undercoat layer between a photosensitive layer formed of a charge generation layer (CGL) and a charge transport layer (CTL), and an electroconductive substrate. FIG. 4 represents an electrophotographic photoreceptor further including a protective layer on the photosensitive layer in FIG. 3. The electrophotographic photoreceptor of the present invention may include other layers besides the above-mentioned layers, provided the electrophotographic photoreceptor includes at least a photosensitive layer on an electroconductive substrate. Types of the photosensitive layer can be combined as desired.

In the present invention, suitable materials for use as the substrate include electroconductive materials and insulators subjected to an electroconductive treatment. For example, metals such as Al, Fe, Cu, and Au or metal alloys thereof; materials in which a thin layer of a metal such as Al, Ag, and Au or a conductive material such as In2O3 and SnO2 is formed on an insulating substrate such as polyester resins, polycarbonate resins, polyimide resins, and glass; and paper subjected to an electroconductive treatment can also be used. Shapes of the electroconductive substrate are not particularly limited, and any substrates having a plate shape, a drum shape, or a belt shape can be used. When a belt-shaped substrate is used, a layout in an image forming apparatus can more freely be designed, although the apparatus becomes complicated or large because of needing a drive roller and a driven roller therein. However, when a protective layer is formed as an outermost layer on the belt-shaped substrate, the protective layer runs short of flexibility and occasionally has a crack on a surface thereof, which possibly causes production of images having background fouling. Therefore, a drum-shaped substrate having a high stiffness is preferably used.

An undercoat layer may be formed between the electroconductive substrate and the photosensitive layer. The undercoat layer is formed for the purpose of improving adherence of the photosensitive layer to the electroconductive substrate, preventing moire, improving coating capability of the above layer, and decreasing a residual potential. The undercoat layer includes a resin as a main component. Since a photosensitive layer is typically formed on the undercoat layer by coating a liquid including an organic solvent, the resin in the undercoat layer preferably has good resistance to general organic solvents. Specific examples of such resins include water-soluble resins, such as polyvinyl alcohol resins, casein and polyacrylic acid sodium salts; alcohol soluble resins, such as nylon copolymers, and methoxymethylated nylon resins; and thermosetting resins capable of forming a three-dimensional network such as polyurethane resins, melamine resins, alkyd-melamine resins, epoxy resins, and the like. The undercoat layer may include a fine powder of metal oxides, such as titanium oxide, silica, alumina, zirconium oxide, tin oxide, and indium oxide to prevent occurrence of moiré in the recorded images and to decrease residual potential of the photoreceptor. The undercoat layer can be formed by using a proper solvent and a conventional coating method.

Further, a metal oxide layer formed by, e.g., a sol-gel method using a silane coupling agent, titanium coupling agent or a chromium coupling agent is effectively used as the undercoat layer.

In addition, a layer of aluminum oxide, which is formed by an anodic oxidation method and a layer of an organic compound such as polyparaxylylene (parylene) or an inorganic compound such as SiO, $SnO_2$, $TiO_2$, ITO, or $CeO_2$, which is formed by a vacuum evaporation method, may be used as the undercoat layer as well.

The undercoat layer preferably has a thickness of from 0.1 to 5 μm.

Any Se or OPC type photosensitive layers can be used as the photosensitive layer for use in the electrophotographic photoreceptor of the present invention. Specific examples of the inorganic materials include crystalline selenium, amorphous selenium, selenium-tellurium alloys, selenium-tellurium-halogen alloys and selenium-arsenic alloys. Particularly, the OPC type photosensitive layers are preferably used because of their inexpensiveness and environment protectiveness, which will be explained below in brief.

The photosensitive layer in the present invention may be single-layered or multi-layered. The multi-layered photosensitive layer will be discussed below. First, the charge generation layer (CGL) will be explained.

The CGL is mainly formed of a charge generation material, and optionally includes a binder resin. Suitable charge generation materials include inorganic materials and organic materials. Specific examples of the inorganic charge generation materials include crystalline selenium, amorphous selenium, selenium-tellurium alloys, selenium-tellurium-halogen alloys, and selenium-arsenic alloys.

Specific examples of the organic charge generation materials include known materials, for example, phthalocyanine pigments such as metal phthalocyanine and metal-free phthalocyanine, azulenium pigments, squaric acid methine pigments, azo pigments having a carbazole skeleton, azo pigments having a triphenylamine skeleton, azo pigments having a diphenylamine skeleton, azo pigments having a dibenzothiophene skeleton, azo pigments having a fluorenone skeleton, azo pigments having an oxadiazole skeleton, azo pigments having a bisstilbene skeleton, azo pigments having a distyryloxadiazole skeleton, azo pigments having a distyrylcarbazole skeleton, perylene pigments, anthraquinone pigments, polycyclic quinone pigments, quinoneimine pigments, diphenyl methane pigments, triphenyl methane pigments, benzoquinone pigments, naphthoquinone pigments, cyanine pigments, azomethine pigments, indigoid pigments, bisbenzimidazole pigments and the like materials. These charge transport materials can be used alone or in combination.

Specific examples of the binder resin optionally used in the CGL include polyamide resins, polyurethane resins, epoxy resins, polyketone resins, polycarbonate resins, silicone resins, acrylic resins, polyvinyl butyral resins, polyvinyl formal resins, polyvinyl ketone resins, polystyrene resins, poly-N-vinylcarbazole resins, polyacrylamide resins, and the like resins. These resins can be used alone or in combination.

In addition, a low-molecular-weight charge transport material may optionally be included in the CGL. Further, a charge transport polymer material is preferably used as the binder resin in the CGL as well, besides the above-mentioned binder resins.

Suitable methods for forming the CGL include thin film forming methods in a vacuum and casting methods using a solution or a dispersion.

Specific examples of the former methods include vacuum evaporation methods, glow discharge decomposition methods, ion plating methods, sputtering methods, reaction sputtering methods, CVD methods, and the like methods. A layer of the above-mentioned inorganic and organic materials can preferably be formed by these methods.

The latter casting methods for forming the CGL include preparing a coating liquid by mixing an inorganic or organic charge generation material mentioned above with a solvent such as tetrahydrofuran, cyclohexanone, dioxane, dichloroethane, butanone, together with a binder resin if necessary; and an additive, and dispersing the mixture with a ball mill, an attritor, a sand mill, etc.; and coating on a substrate the coating liquid, which is diluted if necessary, by a dip coating method, a spray coating method, a bead coating method, etc.

The thus prepared CGL preferably has a thickness of from about 0.01 to about 5 μm, and more preferably from 0.05 to 2 μm.

Next, the charge transport layer (CTL) will be explained.

The CTL has a function to retain charges formed on the photosensitive layer, to transport the carriers, which are selectively generated in the charge generation layer by light irradiating, and to couple the carriers with the retained charges. Therefore, the CTL is required to have a high electric resistance to retain charges, and a small dielectric constant and large charge mobility to obtain a high surface potential with the charges retained on the photosensitive layer.

The CTL satisfying these requirements is formed of a charge transport material, and a binder resin is optionally used. The CTL is formed by dissolving or dispersing the transport material and binder resin in a proper solvent to prepare a coating liquid, and coating and drying the coating liquid. The CTL may optionally include an additive such as a plasticizer, an antioxidant, a leveling agent in a proper amount, besides the transport material and binder resin.

The charge transport materials include positive hole transport materials and electron transport materials.

Specific examples of the electron transport materials include electron accepting materials such as chloranil, bromanil, tetracyanoethylene, tetracyanoquinodimethane, 2,4,7-trinitro-9-fluorenone, 2,4,5,7-tetranitro-9-fluorenone, 2,4,5,7-tetranitro-xanthone, 2,4,8-trinitrothioxanthone, 2,6,8-trinitro-4H-indeno[1,2-b]thiophene-4-one, 1,3,7-trinitrobenzothiophene-5,5-dioxide, and the like compounds. These electron transport materials can be used alone or in combination.

Specific examples of the positive hole transport materials include electron donating materials such as oxazole derivatives, oxadiazole derivatives, imidazole derivatives, triphenylamine derivatives, 9-(p-diethylaminostyrylanthracene), 1,1-bis(4-dibenzylaminophenyl)propane, styrylanthracene, styrylpyrazoline, phenylhydrazone compounds, α-phenylstilbene derivatives, thiazole derivatives, triazole derivatives, phenazine derivatives, acridine derivatives, benzofuran derivatives, benzimidazole derivatives, thiophene derivatives, and the like materials. These positive hole transport materials can be used alone or in combination.

In addition, the charge transport polymer materials may have the following constitutions.

(a) Polymers Having a Carbazole Ring

Specific examples of such polymers include poly-N-vinyl carbazole, and compounds disclosed in Japanese Laid-Open Patent Publications Nos. 50-82056, 54-9632, 54-11737, 4-175337, 4-183719 and 6-234841.

(b) Polymers Having a Hydrazone Skeleton

Specific examples of such polymers include compounds disclosed in Japanese Laid-Open Patent Publications Nos. 57-78402, 61-20953, 61-296358, 1-134456, 1-179164, 3-180851, 3-180852, 3-50555, 5-310904 and 6-234840.

(c) Polysilylene Polymers

Specific examples of such polymers include polysilylene compounds disclosed in Japanese Laid-Open Patent Publications Nos. 63-285552, 1-88461, 4-264130, 4-264131, 4-264132, 4-264133 and 4-289867.

(d) Polymers Having a Triaryl Amine Skeleton

Specific examples of such polymers include N,N-bis(4-methylphenyl)-4-aminopolystyrene, and compounds disclosed in Japanese Laid-Open Patent Publications Nos. 1-134457, 2-282264, 2-304452, 4-133065, 4-133066, 5-40350 and 5-202135.

(e) Other Polymers

Specific examples of such polymers include condensation products of nitropyrene with formaldehyde, and compounds disclosed in Japanese Laid-Open Patent Publications Nos. 51-73888, 56-150749, 6-234836 and 6-234837.

The polymer having an electron donating group for use in the present invention is not limited to the polymers mentioned above, and any known copolymers, block copolymers and graft copolymers and star polymers of known monomers can also be used. In addition, crosslinking polymers having an electron donating group disclosed in, for example, Japanese Laid-Open Patent Publication No. 3-109406 can also be used.

Specific examples of the polycarbonates, polyurethanes, polyesters and polyethers having a triaryl amine structure effectively used as a charge transport polymer material for use in the present include compounds in Japanese Laid-Open Patent Publications Nos. 64-1728, 64-13061, 64-19049, 4-11627, 4-225014, 4-230767, 4-320420, 5-232727, 7-56374, 9-127713, 9-222740, 9-265197, 9-211877 and 9-304956.

Specific examples of the binder resin used together with the charge transport material in the CTL include polycarbonate, polyester, methacrylic resins, acrylic resins, polyethylene, vinylchloride, vinylacetate, polystyrene, phenol resins, epoxy resins, polyurethane, polyvinylidenechloride, alkyd resins, silicone resins, polyvinylcarbazole, polyvinylbutyral, polyvinylformal, polyacrylate, polyacrylamide and phenoxy resins. These binder resins can be used alone or in combination.

The CTL preferably has a thickness of from 5 to 100 μm, and more preferably from 5 to 30 μm, due to recent requirements for higher image quality to produce high-quality images having not less than 1,200 dpi.

The CTL of the present invention may include other antioxidants and plasticizers used, for example, in rubbers, plastics, oils, and fats.

In addition, the CTL may include a leveling agent. Specific examples of such leveling agents include silicone oils such as dimethyl silicone oils and methylphenyl silicone oils; and polymers and oligomers having a perfluoroalkyl group in their side chain. A content of the leveling agent is from 0 to 1 part by weight per 100 parts by weight of the binder resin.

The charge transport layer can be formed by a conventional coating method such as dip coating methods, spray coating methods, and bead coating methods.

Further, when the CTL is an outermost layer, the CTL includes at least a particulate fluorocarbon resin.

When the CTL includes the particulate fluorocarbon resin, the CTL preferably includes more particulate fluorocarbon resins around a surface thereof to more efficiently exert an effect of its low friction coefficient. Namely, what exerts an effect of the low friction coefficient is the projected particulate fluorocarbon resin from a surface of a photoreceptor, and particulate fluorocarbon resin may be included in an upper part of the CTL than a thickness thereof abraded due to repeated use, with which the photoreceptor no longer works. This is because the particulate fluorocarbon resin in the thickness will be wasted, and would rather have a bad influence on the photoreceptor. As a method of preparing a photoreceptor having a CTL including a particulate fluorocarbon resin more around a surface thereof, a method of coating a CTL coating liquid including the particulate fluorocarbon resin after coating a CTL coating liquid excluding the particulate fluorocarbon resin can be considered.

Specifically, a CGL is coated with a CTL coating liquid excluding the particulate fluorocarbon resin to form a first CTL thereon, and the first CTL is coated with a CTL coating liquid including a solid content of 40% by volume of the particulate fluorocarbon resin to form a second CTL to prepare a CTL including the particulate fluorocarbon resin more around a surface thereof.

Known coating methods such as dip coating methods and spray coating methods can be used.

The CTL preferably include the particulate fluorocarbon resin in an amount of from 20 to 60% by volume, and more preferably from 30 to 50% by volume. In addition, the particulate fluorocarbon resins can be dispersed on a surface of the CTL and projected therefrom. When the CTL includes the particulate fluorocarbon resin in an amount less than 20% by volume, the particulate fluorocarbon resin has less area of the surface of the CTL and continuousness of a low surface friction coefficient thereof deteriorates. When the CTL includes the particulate fluorocarbon resin in an amount greater than 60% by volume, the CTL inevitably includes less binder resins and a mechanical strength thereof deteriorates, and the particulate fluorocarbon resins more frequently contact to one another to increase agglomerated secondary particle and its particle diameter.

The particulate fluorocarbon resin preferably has a primary particle diameter not too small and not too large to satisfy preferable average diameters of the primary and secondary particles. Specifically, the particulate fluorocarbon resin preferably has a primary particle diameter of from 0.1 to 0.3 μm.

Specific examples of a method of dispersing the particulate fluorocarbon resin include known methods, e.g., a dispersion method using dispersion media such as a ball mill, a beads mill, a sand mill, and a vibration mill; and a high-speed liquid colliding dispersion method using a Micro Fluidizer from MFI or an Ultimizer from Sugino Machine Limited. However, the secondary particles have large particle diameter distribution differences depending on the dispersion method, and the particulate fluorocarbon resin needs to be dispersed so as to be in a range of the claim of the present invention.

As a preferable dispersion method, in the dispersion method using dispersion media, it is preferable not to apply an excessive energy to the particulate fluorocarbon resin and to apply a supersonic thereto after dispersed with the a dispersion media. The present inventors discovered that the vibration mill preferably uses a dispersion media having a smaller diameter and a properly moderate vibration speed such that the secondary particle diameter becomes small. The present inventors also discovered that a solid content in the dispersion method using dispersion media preferably has comparatively a high concentration and that the secondary particle diameter distribution largely differs depending on conditions of preparing a coating liquid such as including a binder resin after dispersion.

In the high-speed liquid colliding dispersion method, a solid content when dispersed with the Ultimizer preferably has a low concentration, and the secondary particle diameter distribution largely differs depending on a liquid collision pressure, a solvent, and a ratio of solvents when mixed. Therefore, a coated layer in a range of the present invention needs to be formed, fully considering these conditions.

Next, as a method of computing an average diameter and an area ratio of an image of the particulate fluorocarbon resin of the present invention, projected from a surface of a coated layer, an observation with a scanning electron microscope (SEM) will be explained. However, the method is not limited thereto, so long as the projection status of the particulate fluorocarbon resin can be observed.

An average diameter, a number and an area ratio of the particulate fluorocarbon resin can be determined by photographing a surface of an electrophotographic photoreceptor, on which the particulate fluorocarbon resin is dispersed, with a SEM; and analyzing an image thereof reflected on a SEM image with an image analyzer. The SEM image is photographed from above, and the image of the particulate fluorocarbon resin is also an image seen from above. The average diameter is an average of an inner diameter passing through a center of gravity of the image of each particle including agglomerated particles when measured at intervals of every angle of 2°.

The image analyzer needs to separate the image of the particulate fluorocarbon resin from a binder resin around the particulate fluorocarbon resin, and regard the secondary particle formed of agglomerated plural primary particles as a large particle. Further, the image analyzer needs to be programmed to compute a diameter and an area ratio of each particulate fluorocarbon resin. Specific examples of the image analyzer include dedicated devices such as a highly-detailed image analyzing system IP-1000 from Asahi Engineering Co., Ltd. and computers installed with an image analyzing software Image-Pro Plus from Planetron, Inc.

Even an inner status around a surface can occasionally be imaged as a SEM image when the SEM has a high acceleration voltage. When a particulate fluorocarbon resin is dispersed with a binder resin, even the particulate fluorocarbon resin internally present around a surface is occasionally seen through and observed with a SEM when having a high acceleration voltage. Therefore, the acceleration voltage needs to be adjusted so as to reflect only the particulate fluorocarbon resin projected from the surface.

For example, when a field emission SEM S-4200 from Hitachi, Ltd. is used as a SEM, the acceleration voltage is preferably from 2 to 6 kv, which needs to optionally be adjusted according to the analyzer and materials of a photoreceptor.

The thus prepared SEM image is read with image analyzing software to compute an average diameter and an area ratio of the individual particulate fluorocarbon resin observed with the SEM.

The CTL of the photoreceptor of the present invention may include a filler besides the particulate fluorocarbon resin, when the CTL is an outermost layer.

Filler materials for use in the CTL include organic and inorganic fillers. Specific examples of organic filler materials include a fluorocarbon resin powder such as polytetrafluoroethylene, a silicone resin powder and an α-carbon powder. Specific examples of inorganic filler materials include metallic powders such as copper, tin, aluminium and indium; metal oxides such as silica, tin oxide, zinc oxide, titanium oxide, alumina, zirconium oxide, indium oxide, stibium oxide, bismuth oxide, calcium oxide, zinc oxide doped with stibium and indium oxide doped with zinc; metal fluorides such as zinc fluoride, calcium fluoride and aluminium fluoride; and inorganic materials such as kalium titanate and boron nitride.

The inorganic filler can improve abrasion resistance of the outermost layer of the photoreceptor more than the organic filler because of its higher hardness compared to that of the organic filler. However, typically, when an abrasion resistance of a latent image bearer is improved, a surface thereof is scarcely abraded, but has a low resistance due to a reactive gas such as ozone and NOx, and gradually static electricity of the surface is not maintained. Therefore, an electrostatic latent image blurs, resulting in abnormal images, such as blurred images and distorted images, when the electrostatic latent image is developed with a toner. Then, the filler for use in the present invention preferably has a high resistance not less than 10 Ω·cm. Such a filler can prevent a low resistance of an outermost layer of a photoreceptor and largely prevent production of the above-mentioned abnormal images.

Among these filler materials, the silica, titanium oxide, and alumina are effectively used. In addition, since these filler materials are less expensive than the other particulate metal oxides and easy to obtain, production cost of the photoreceptor can be reduced.

Among the fillers, particularly an α-type alumina with a hexagonal close-packed structure having a high insulation, heat resistance and abrasion resistance is preferably used for preventing blurred images and improving abrasion resistance. These filler materials can be used alone or in combination.

The fillers can be dispersed with a charge transport material, a binder resin, a solvent, etc. by a proper disperser. In addition, the filler preferably has an average primary particle diameter of from 0.05 to 1.0 μm, and more preferably from 0.1 to 0.3 μm. When less than 0.05 μm, abrasion resistance of the resultant photoreceptor is occasionally insufficient. When greater than 1.0 μm, the filler scatters writing light irradiated to a latent image bearer to deteriorate a transmission of the resultant CTL, resulting in blurred and expanded images.

The filler in an outermost layer has different concentrations according to types of the filler and electrophotographic process conditions, and preferably has a concentration of from 5 to 60% by weight. The filler can unevenly be included in the CTL. However, since an irradiated part of the resultant photoreceptor occasionally has a high potential, the filler preferably has a concentration gradient so as to have a higher concentration toward an outermost layer of the CTL and a lower concentration toward an en electroconductive substrate. Otherwise, the CTL preferably has plural layers so as to have higher concentrations of the filler toward a surface thereof from an en electroconductive substrate.

Next, a single-layered photosensitive layer will be explained.

When the single-layered photosensitive layer is formed by a casting method, the single-layered photosensitive layer can be formed by dissolving or dispersing a charge generation material, low-molecular-weight charge transport material, and a charge transport polymer material in a proper solvent to prepare a solution or a dispersion liquid; and coating and drying the solution or dispersion liquid in many cases. The above-mentioned charge generation materials and charge transport material can be used.

In addition, the single-layered photosensitive layer can optionally include a plasticizer. Further, the binder resins optionally used in the above-mentioned CTL can be used, and the binder resins used in the CGL can be mixed therewith.

When the single-layered photosensitive layer is an outermost layer of a photoreceptor, the single-layered photosensitive layer includes at least a particulate fluorocarbon resin present in a dispersed status of the present invention.

The thus prepared single-layered photosensitive layer has the same functions as those of the above-mentioned CTL.

In addition, similarly to the above-mentioned CTL, the single-layered photosensitive layer preferably includes more particulate fluorocarbon resins around a surface hereof, and such a single-layered photosensitive layer can be prepared by the similar method.

The single-layered photosensitive layer preferably has a thickness of from 5 to 100 μm.

The photoreceptor of the present invention may include a protective layer on a photosensitive layer. Specific examples of materials for use in the protective layer include ABS resins, ACS resins, olefin-vinyl monomer copolymers, chlorinated polyethers, aryl resins, phenolic resins, polyacetal, polyamides, polyamideimide, polyacrylates, polyarylsulfone, polybutylene, polybutylene terephthalate, polycarbonate, polyethersulfone, polyethylene, polyethylene terephthalate, polyimides, acrylic resins, polymethylpentene, polypropylene, polyphenyleneoxide, polysulfone, polystyrene, AS resins, butadiene-styrene copolymers, polyurethane, polyvinyl chloride, polyvinylidene chloride, epoxy resins and the like resins.

The protective layer includes a particulate fluorocarbon resin because of being an outermost layer. The protective layer is formed mainly for improving an abrasion resistance of the resultant photoreceptor. In the present invention, the protective layer including the particulate fluorocarbon resin in a preferable dispersed status thereof maintains a low friction coefficient of the resultant photoreceptor against repeated use and improves an abrasion resistance thereof for long periods. Further, since the protective layer formed on a photosensitive layer has comparatively a small thickness and does not largely affect electric properties of a photoreceptor, the particulate fluorocarbon resin is more included therein than the CTL and a formulation specialized for the low friction coefficient and abrasion resistance can be used to form the protective layer to functionally differentiate the protective layer from the CTL.

Further, the protective layer may include a filler material to have further abrasion resistance. The above-mentioned filer materials can be used alone or in combination.

A charge transport material is effectively included in the protective layer to prevent deterioration of electric properties, particularly of photosensitivity and to increase residual potential of the resultant photoreceptor. It is considered that this is because a charge can smoothly transport to a surface of a photoreceptor when the protective layer has charge transportability. The charge transport materials used in the above-mentioned CTL can be used.

Further, the protective layer of the electrophotographic photoreceptor of the present invention may include various additives to improve adhesiveness, smoothness and chemical stability thereof.

The protective layer of the present invention is formed on a photosensitive layer by a conventional coating method such as a dip coating method, a spray coating method, a blade coating method, and a knife coating method. Particularly, the dip coating method and spray coating method are advantageously used in terms of mass-productiveness and coated layer quality.

However, coating conditions of each method are very important because of fluctuating a dispersed status of the particulate fluorocarbon resin.

For example, in the spray coating method, a solid content concentration, and solvents and a mixing ratio thereof when a mixed solvent is used are essential for coating liquid conditions; a discharge amount, an atomized air pressure, a distance between a tip of sprayer and a surface of a material to be coated, a transport speed of the surface thereof and a number of recoating are essential for sprayer conditions. For example, when a protective layer having a desired thickness is formed by decreasing the discharge amount of a coating liquid and increasing the number of recoating, a dryer protective layer is formed. When the discharge amount is increased and the number of recoating is decreased, a wetter protective layer is formed. Further, the coating liquid in a tank needs to be stirred to prevent sedimentation of the particulate fluorocarbon resin. Even a status of a layer being coated affects a status of the particulate fluorocarbon resin on a surface thereof. Therefore, various coating conditions needs to be studied to obtain a preferable condition such that the particulate fluorocarbon resin has a status of the present invention.

The thus prepared protective layer preferably has a thickens of from 0.1 to 15 μm, and more preferably from 1 to 10 μm.

Next, the image forming apparatus of the present invention will be explained, referring to the drawings.

Figure 5:
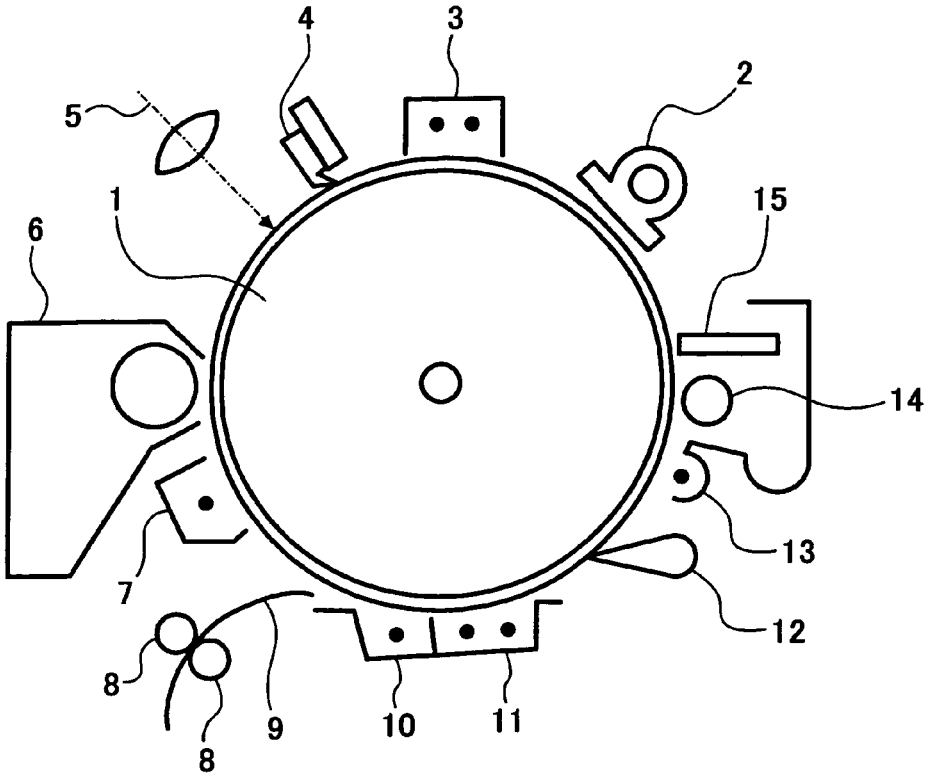
FIG. 5 is a schematic view illustrating a partial cross-section of an embodiment of the electrophotographic image forming apparatus of the present invention.

FIG. 5 is a schematic view illustrating a partial cross-section of an embodiment of the electrophotographic image forming apparatus of the present invention. A modified embodiment as mentioned below belongs to the present invention.

As shown in FIG. 5, the image forming apparatus of the present invention includes a drum-shaped photoreceptor (1), a charger (3), a pre-transfer charger (7), a transfer charge (10), a separation charger (11), a pre-cleaning charger (13), and a contact member (4), which frictionalizes a surface of the outermost layer of the photoreceptor while contacting the surface thereof. The shape of a photoreceptor is not limited to the shape of a drum, and may be the shape of a sheet or shape of an endless-belt. Any known chargers such as a corotron, a scorotron, a solid state charger, and a charging roller can be used for the above-mentioned chargers.

The above-mentioned chargers can be used as a transferer, and typically a combination of the transfer charger and separation charger as shown in FIG. 5 is effectively used.

Suitable light sources for use in an imagewise light irradiator (5) and a discharging lamp (2) include fluorescent lamps, tungsten lamps, halogen lamps, mercury lamps, sodium lamps, light emitting diodes (LEDs), laser diodes (LDs), light sources using electroluminescence (EL), and the like. In addition, in order to obtain light having a desired wavelength range, filters such as sharp-cut filters, band pass filters, near-infrared cutting filters, dichroic filters, interference filters, color temperature converting filters and the like can be used.

The above-mentioned light sources can be used for not only the processes mentioned above and illustrated in FIG. 5, but also other processes, such as a transfer process, a discharging process, a cleaning process, a pre-exposure process, which include light irradiation to the photoreceptor.

When a toner image formed on the photoreceptor (1) by a developing unit (6) is transferred onto a transfer sheet (9), which is fed by a pair of resist rollers (8), the toner image is not all transferred thereon, and residual toner particles remain on the surface of the photoreceptor (1). The residual toner is removed from the photoreceptor by a fur brush (14) and a blade (15). The transfer sheet (9) is separated by the separation pick (12) after the toner image is transferred. The residual toner remaining on the photoreceptor (1) can be removed by only a cleaning brush. Suitable cleaning brushes include known cleaning brushes such as fur brushes and mag-fur brushes.

When a photoreceptor positively or negatively charged is exposed to imagewise light, an electrostatic latent image having a positive or negative charge is formed thereon. When the latent image having a positive charge is developed with a toner having a negative charge, a positive image can be obtained. In contrast, when the latent image having a positive charge is developed with a toner having a positive charge, a negative image (i.e., a reversal image) can be obtained.

As the developing method, known developing methods can be used. In addition, as the discharging methods, known discharging methods can also be used.

The image forming apparatus of the present invention can be equipped with a contact member contacting and frictionizing an electrophotographic photoreceptor.

Specific examples of the contact member include a contact member for the purpose of frictionizing a projected part of the particulate fluorocarbon resin, and a contact charger such as a charging roller, a cleaner such as a cleaning blade and a cleaning brush, a transferer such as a transfer belt and an intermediate transferer, which are typically used in an image forming apparatus and have pressurizing mechanism. Frictionizing a surface of a photoreceptor by the cleaning blade (15) will be explained. The cleaning blade frictionizes almost all surface of the photoreceptor while pressuring the surface thereof at an almost even pressure, and uniformly accrete the particulate fluorocarbon resin on the surface.

The cleaning blade preferably has a contact angle of from 10 to 30°, a contact pressure of from 0.3 to 4 g/mm, a urethane rubber hardness of from 60 to 70° as a blade, an impact resilience of from 30 to 70%, a Young's modulus of from 30 to 60 kgf/cm$^2$, a thickness of from 1.5 to 3.0 mm, a free length of from 7 to 12 mm and an impressed amount of the blade edge to the photoreceptor of from 0.2 to 2 mm.

Figure 6:
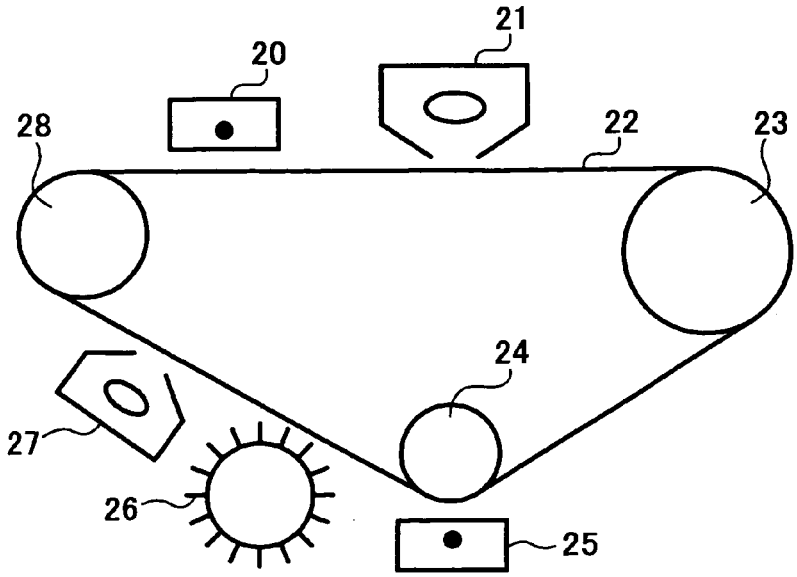
FIG. 6 is a schematic view illustrating another embodiment of the electrophotographic image forming apparatus of the present invention.

FIG. 6 is a schematic view illustrating another embodiment of the electrophotographic image forming apparatus of the present invention. A photoreceptor (22) is the photoreceptor of the present invention, and is driven by a drive roller (23), a driven roller 28, and a tension roller 24, which applies tension to the photoreceptor. Charging using a charger (20), imagewise exposure using an imagewise light irradiator (21), developing using a developing unit (not shown), transferring using a transfer charger (25), cleaning using a cleaning brush (26), and discharging using a discharging light source (27) are repeatedly performed.

Further, as a full-color image forming apparatus using the present invention, an embodiment of an electrophotographic printer (hereinafter referred to as a printer) will be explained.

Figure 7:
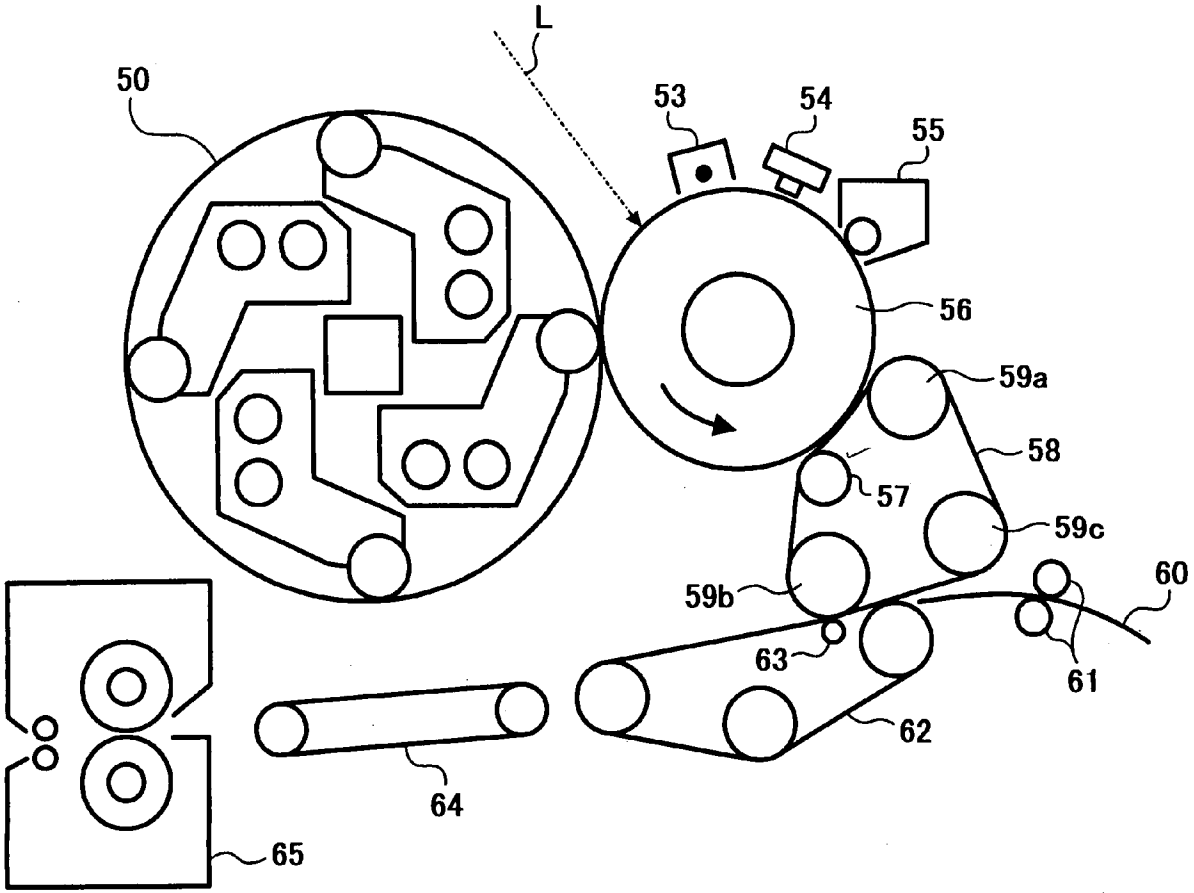
FIG. 7 is a schematic view illustrating a third embodiment of the electrophotographic image forming apparatus (printer) of the present invention.

FIG. 7 is a schematic view illustrating a third embodiment of the electrophotographic image forming apparatus (printer) of the present invention. In FIG. 7, after a surface of a photoreceptor (56) as an image bearer is uniformly charged by a charger (53) using a corotron or a scorotron while rotated counterclockwise, the photoreceptor is scanned by a laser beam (L) emitted from a laser optical device (not shown) to bear an electrostatic latent image. Since the photoreceptor is scanned based on image information of each single color, i.e., yellow, magenta, cyan, and black decomposed from a full-color image, an electrostatic latent image having a single color, i.e., yellow, magenta, cyan, or black is formed on the photoreceptor (56). A revolver developing unit (50) is located on the left side of the photoreceptor (56). The revolver developing unit (50) has a yellow image developer, a magenta image developer, a cyan image developer, and a black image developer in its rotating drum-shaped chassis, and rotates to sequentially locate each image developer in a developing position facing the photoreceptor (56). The yellow image developer, magenta image developer, cyan image developer, and black image developer develop an electrostatic latent image by adhering a yellow toner, a magenta toner, a cyan toner, and a black toner respectively thereto. An electrostatic latent image having each color is sequentially formed on the photoreceptor (56), and is sequentially developed by each image developer of the revolver developing unit (50) to form a yellow toner image, a magenta toner image, a cyan toner image, and a black toner image.

An intermediate transfer unit is located in the downstream of rotation direction of the photoreceptor (56) from the developing position. The intermediate transfer unit endlessly rotates an intermediate transfer belt (58) stretched by a stretch roller (59*a*), an intermediate transfer bias roller (57) as a transferer, a second-transfer backup roller (59*b*) and a belt drive roller (59*c*) clockwise with a rotary drive thereof. The yellow toner image, magenta toner image, cyan toner image, and black toner image are transferred to an intermediate transfer nip where the photoreceptor (56) and the intermediate transfer belt (58) contact each other. Then, the yellow toner image, magenta toner image, cyan toner image and black toner image are transferred onto the intermediate transfer belt (58) while affected by a bias from the intermediate transfer bias roller (57), and overlapped thereon to form a four-color overlapped toner image.

A residual toner after transfer on a surface of the photoreceptor (56) which passed the intermediate transfer nip in accordance with the rotation is cleaned by a cleaning unit (55). The cleaning unit (55) cleans the residual toner after transfer with a cleaning roller to which a cleaning bias is applied to. However, the cleaning unit (55) may use a cleaning brush such as a fur brush and a mag-fur brush or a cleaning blade.

The surface of the photoreceptor (56), the residual toner on which after transfer is cleaned, is discharged by a discharging lamp (54). Fluorescent lamps, tungsten lamps, halogen lamps, mercury lamps, sodium lamps, light emitting diodes (LEDs), laser diodes (LDs), light sources using electroluminescence (EL), and the like are used for the discharging lamp (54). Filters such as sharp-cut filters, band pass filters, near-infrared cutting filters, dichroic filters, interference filters, color temperature converting filters, and the like can be used to obtain light having a desired wavelength range.

On the other hand, a resist roller (61) sandwiching a transfer paper (60) fed from a paper feeding cassette (not shown) between two rollers feeds the transfer paper (60) to the second transfer nip in time for overlapping the transfer paper (60) on the four-color overlapped toner image on the intermediate transfer belt (58). The four-color overlapped toner image on the intermediate transfer belt (58) is secondly transferred onto the transfer paper (60) at a time in the second transfer nip with a second transfer bias from a paper transfer bias roller (63). This second transfer forms a full-color image on the transfer paper (60).

The transfer paper (60) a full-color image is formed on is fed to a paper transfer belt (64) by a transfer belt (62).

The paper transfer belt (64) feeds the transfer paper (60) from the transfer unit to a fixer (65).

The fixer (65) transfers the transfer paper (60) while passing the transfer paper (60) through a fixing nip formed of a contact between a heating roller and a backup roller.

The full-color image on the transfer paper (60) is fixed thereon with a heat from the heating roller and a pressure in the fixing nip.

A bias is applied to the transfer belt (62) and paper transfer belt (64) to draw the transfer paper (60) thereon, although not shown. A paper discharger discharging the transfer paper (60), and three dischargers discharging each belt, i.e., the intermediate transfer belt (58), transfer belt (62) and paper transfer belt (64) are arranged. The intermediate transfer unit is also equipped with a belt cleaning unit similar to the drum cleaning unit (55), which cleans a residual toner on the intermediate transfer belt (58) after transfer.

Figure 8:
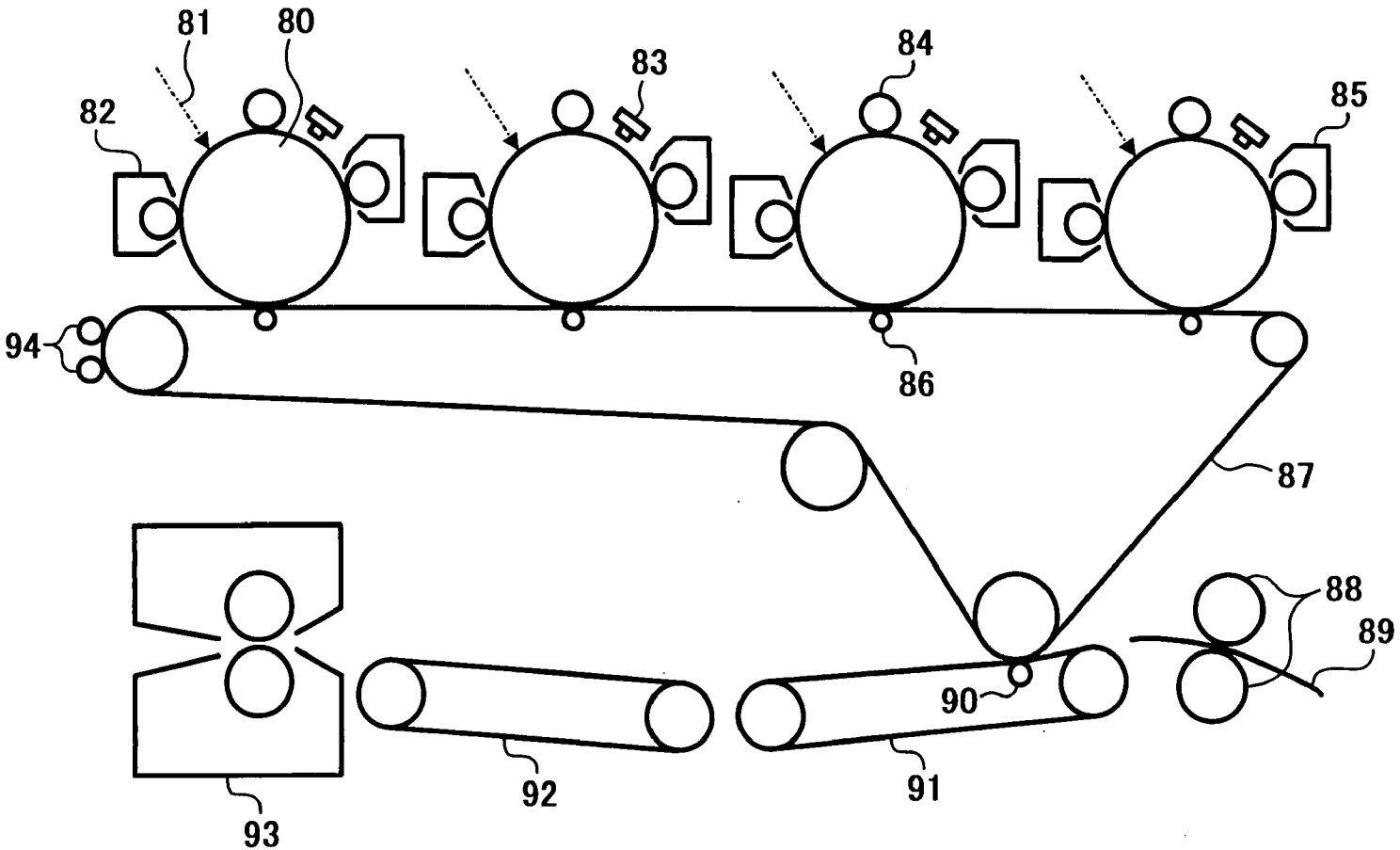
FIG. 8 is a schematic view illustrating a modified embodiment of the electrophotographic image forming apparatus (printer) of the present invention.

FIG. 8 is a schematic view illustrating a modified embodiment of the electrophotographic image forming apparatus (printer) of the present invention. This is a tandem-type image forming apparatus including an intermediate transfer belt (87), in which a photoreceptor drum (80) is not shared by each color, and is equipped with photoreceptor drums (80Y), (80M), (80C) and (80Bk) (not shown) for each color. The photoreceptor drum 80 is representative of the four photoreceptor drums (80Y), (80M), (80C) and (80Bk), which can be arranged in a random order for each respective color. In addition, the tandem-type image forming apparatus is also equipped with a drum leaning unit (85), a discharging lamp (83) and a charging roller (84) uniformly charging the drum for each color. In addition, FIG. 8 shows an irradiator (81), a transfer sheet (89), a pair of resist rollers (88) sandwiching the transfer sheet, a paper transfer bias roller (90) applying a transfer bias, a transfer belt (91) transferring the transfer sheet onto a paper transfer belt (92), a fixer (93) that fixes a toner image on the transfer sheet (89), and a pair of fur brushes (87), which clean the intermediate transfer belt (87). In the tandem-type image forming apparatus the charging roller (84) is used as a charger charging the drum while the charger (53) is used in the printer in FIG. 7.

The tandem-type image forming apparatus can form a latent image and develop in parallel, and can form an image at a far higher speed than that of the revolver-type image forming apparatus. Having generally described this invention, further understanding can be obtained by reference to certain specific examples which are provided herein for the purpose of illustration only and are not intended to be limiting. In the descriptions in the following examples, the numbers represent weight ratios in parts, unless otherwise specified.

EXAMPLES

Example 1

The following materials were mixed and dispersed in a ball mill for 12 hrs to prepare an undercoat layer coating liquid:

| | |
|---|---|
| Alkyd resin (Bekkolite M6401-50 from Dainippon Ink & Chemicals, Inc.) | 15 |
| Melamine resin (Super Bekkamin G-821-60 from Dainippon Ink & Chemicals, Inc.) | 10 |
| Methyl ethyl ketone | 150 |
| Titanium oxide powder (Tipaque CR-El from Ishihara Sangyo Kaisha, Ltd.) | 90 |

The thus prepared undercoat layer coating liquid was coated on a cylindrical aluminium substrate having a diameter of 90 mm and a length of 392 mm by a dip coating method, and the coated liquid was dried at 130° C. for 20 min to form an undercoat layer having a thickness of 3.5 μm on the substrate.

Next, the following materials were mixed and dispersed in a ball mill for 48 hrs to prepare a mixture:

| | |
|---|---|
| Polyvinylbutyral resin (XYHL from Union Carbide Corp.) | 4 |
| Cyclohexanone | 150 |
| Bisazo pigment having the following Formula (1): | 10 |

(1)

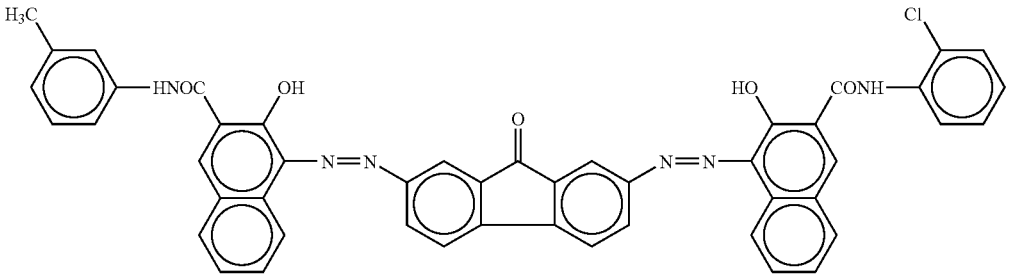

Further, 210 parts of cyclohexanone were included in the mixture and the mixture was dispersed for 3 hrs. The dispersed mixture was put in a vessel and diluted with cyclohexanone so as to have a solid content of 1.5% by weight. The thus prepared CGL coating liquid was coated on the undercoat layer by a dip coating method, and the coating liquid was dried at 130° C. for 20 min to form a CGL having a thickness of 0.2 μm.

Next, the following materials were mixed to prepare a CTL coating liquid:

| | |
|---|---|
| Tetrahydrofuran | 100 |
| Bisphenol Z-type polycarbonate resin | 10 |
| Silicone oil (KF-50 from Shin-Etsu Chemical Co., Ltd.) | 0.002 |
| Charge transport material having the following formula (2) | 10 |

-continued (2)

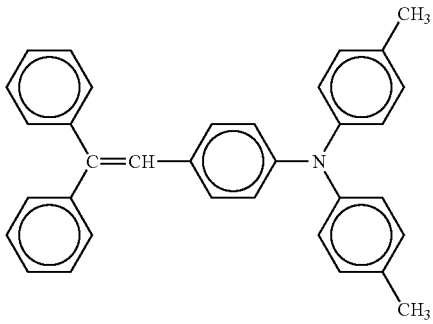

The thus prepared CTL coating liquid was coated on the CGL by a dip coating method, and the liquid was dried at 110° C. for 20 min to form a CTL having a thickness of 20 μm.

Next, the following materials were dispersed by a high-speed liquid collision disperser Ultimizer HJP-25005 from Sugino Machine Limited under a pressure of 100 Mpa for 1 hr to prepare a PFA dispersion.

| | |
|---|---|
| Particulate perfluoroalkoxy resin (PFA) (MPE-056 from DU PONT-MITSUI FLUOROCHEMICALS COMPANY, LTD) | 18 |
| Tetrahydrofuran | 60 |
| Cyclohexanone | 20 |
| Dispersion auxiliary agent (Modiper F210 from NOF Corp.) | 2 |

100 parts of the PFA dispersion were included in a resin liquid formed of 16 parts of Bisphenol Z-type polycarbonate resin dissolved in a mixed solvent of 420 parts of tetrahydrofuran and 120 of cyclohexanone to prepare a coating liquid. Then, the coating liquid is insonified for 10 min to prepare a protective layer coating liquid. The thus prepared protective layer coating liquid was coated on the CTL with a spray gun (PC308 from Olympos Co., Ltd.) at an air pressure of 2 kgf/cm$^2$ for three times, and the coating liquid was dried at 130° C. for 20 min to form a protective layer having a thickness of 5 μm. Thus, an electrophotographic photoreceptor in Example 1 was prepared.

Randomly sampled 10 points of a surface of the electrophotographic photoreceptor were photographed using a SEM (S-4200 from Hitachi, Ltd.) at an acceleration voltage of 2 kv and a magnification of 4,000 times to prepare a SEM image. The SEM image was analyzed using an image processing software (IMAGE Pro Plus) to determine a number of PFA particles (including primary and agglomerated secondary particles), an average diameter, an area and an area ratio of each particle. Total area ratio of particles having an average diameter of from 0.15 to 3 μm was S1, and total area ratio of particles having an average diameter of from 0.2 to 1.5 μm was S2.

Next, an example of preparing a polymerized toner for use in the present invention will be explained.

The following materials were mixed and dispersed by a ball mill for 24 hrs to prepare a monomer composition.

| | |
|---|---|
| Styrene monomer | 70 |
| n-butylmethacrylate | 30 |
| Polystyrene | 5 |
| 3,5-di-tert-zincbutylsalicylate salt | 2 |
| Carbon black | 6 |

400 ml of an aqueous solution including polyvinylalcohol of 2% were put in a flask equipped with a stirrer, a thermometer, an inactive gas inlet tube and a porous glass tube having a diameter 10 mm and a length of 50 mm with pores having a pore diameter of 110,000 Å and a pore capacity of 0.42 cc/g. The aqueous solution was stirred while a nitrogen gas was fed in the flask and oxygen therein was replaced with nitrogen.

Next, 1.56 g of azobisisobutylnitrile were stirred and dissolved in 113 g of the monomer composition to prepare a mixture, and the mixture was passed through the porous glass tube by a pump and included in the polyvinylalcohol aqueous solution. After a mixture of the polyvinylalcohol and monomer composition was circulated for 2 hrs at a 120 ml/min using the pump and porous glass tube, the mixture was polymerized for 8 hrs at an inner temperature of 70° C.

Then, after the polymerized mixture was cooled to have a room temperature and left for a night, a supernatant liquid was removed therefrom and water was included therein, and the mixture was stirred for 1 hr, filtered and dried to prepare a toner. A particle diameter of the toner was measured by a Coulter counter to find that the toner had an average particle diameter of 8.5 μm, 95% thereof had particle diameters of from 5 to 10 μm and that the toner had quite a narrow particle diameter distribution.

In addition, the toner had an average circularity of 0.98. The average circularity was determined by passing a suspension liquid including toner particles through a flat plate imaging detection zone, optically detecting and analyzing the particle image with a CCD camera, and dividing a circumferential length of an equivalent circle having an equivalent area to the particle image with a circumferential length of the actual particle.

The polymerized toner was mixed with a carrier so as to have a concentration of 4% to prepare a two-component developer.

The two-component developer and the electrophotographic photoreceptor were installed in a modified full-color complex machine Imagio Color 5100 from Ricoh Company, Ltd., wherein an imagewise light source was replaced with a laser diode having a wavelength of 655 nm, a lubricant applicator was removed, and a cleaning blade contact pressure to the electrophotographic photoreceptor and gap between an image developer and the electrophotographic photoreceptor were adjusted to increase a load to an abrasion thereof. After a charger voltage is adjusted such that a potential of a non-irradiated part of the electrophotographic photoreceptor (VD) was −700 V, 50,000 images having an A4 size and a 600 dpi image area ratio of 5% were produced. From a difference between thickness of a photosensitive layer of the electrophotographic photoreceptor before and after the 50,000 images were produced, an abrasion amount thereof was determined. The thickness was measured by an eddy-current thickness meter Fischer Scope MMS from Fischer AG. Further, image quality before and after the 50,000 images were produced was evaluated as well.

Background fouling was ranked to the following 5 grades.

5: almost no background fouling was observed good level

4: background fouling was slightly observed and almost no problem

3: background fouling was somewhat observed, but not a problem in practical use

2: background fouling was noticeable, and not preferable in practical use

1: not acceptable in practical use

Example 2

The procedures of preparation and evaluation of the electrophotographic photoreceptor in Example 1 were repeated to prepare and evaluate an electrophotographic photoreceptor of Example 2 except for including 55 parts of the PFA dispersion in the resin liquid formed of 16 parts of Bisphenol Z-type polycarbonate resin dissolved in the mixed solvent of 420 parts of tetrahydrofuran and 120 of cyclohexanone to prepare a coating liquid; and insonifying the coating liquid for 10 min to prepare a protective layer coating liquid.

Example 3

The procedures of preparation and evaluation of the electrophotographic photoreceptor in Example 1 were repeated to prepare and evaluate an electrophotographic photoreceptor of Example 3 except for including 300 parts of the PFA dispersion in the resin liquid formed of 16 parts of Bisphenol Z-type polycarbonate resin dissolved in the mixed solvent of 420 parts of tetrahydrofuran and 120 of cyclohexanone to prepare a coating liquid; and insonifying the coating liquid for 10 min to prepare a protective layer coating liquid.

Example 4

The procedures of preparation and evaluation of the electrophotographic photoreceptor in Example 1 were repeated to prepare and evaluate an electrophotographic photoreceptor of Example 4 except for changing the pressure to 60 Mpa and the time to 20 min in the high-speed liquid collision disperser Ultimizer HJP-25005 from Sugino Machine Limited to prepare a PFA dispersion.

Example 5

The procedures of preparation and evaluation of the electrophotographic photoreceptor in Example 1 were repeated to prepare and evaluate an electrophotographic photoreceptor of Example 5 except for including 55 parts of the PFA dispersion in a resin liquid formed of 16 parts of Bisphenol Z-type polycarbonate resin and 10 parts of the charge transport material having the formula (2) dissolved in the mixed solvent of 420 parts of tetrahydrofuran and 120 of cyclohexanone to prepare a coating liquid; and insonifying the coating liquid for 10 min to prepare a protective layer coating liquid.

Example 6

The procedures of preparation and evaluation of the electrophotographic photoreceptor in Example 1 were repeated to prepare and evaluate an electrophotographic photoreceptor of Example 6 except for using a particulate polytetrafluoroethylene resin (PTFE) instead of PFA.

Example 7

The procedures of preparation and evaluation of the electrophotographic photoreceptor in Example 2 were repeated to prepare and evaluate an electrophotographic photoreceptor of Example 7 except for using a particulate polytetrafluoroethylene resin (PTFE) instead of PFA.

Comparative Example 1

The procedures of preparation and evaluation of the electrophotographic photoreceptor in Example 1 were repeated to prepare and evaluate an electrophotographic photoreceptor of Comparative Example 1 except for dispersing with a ball mill using glass beads having a diameter of 1 mm for 48 hrs instead of the high-speed liquid collision disperser Ultimizer HJP-25005 from Sugino Machine Limited to prepare a PFA dispersion.

Comparative Example 2

The procedures of preparation and evaluation of the electrophotographic photoreceptor in Example 2 were repeated to prepare and evaluate an electrophotographic photoreceptor of Comparative Example 2 except for dispersing with a ball mill using glass beads having a diameter of 1 mm for 48 hrs instead of the high-speed liquid collision disperser Ultimizer HJP-25005 from Sugino Machine Limited to prepare a PFA dispersion.

Comparative Example 3

The procedures of preparation and evaluation of the electrophotographic photoreceptor in Example 3 were repeated to prepare and evaluate an electrophotographic photoreceptor of Comparative Example 3 except for dispersing with a ball mill using glass beads having a diameter of 1 mm for 48 hrs instead of the high-speed liquid collision disperser Ultimizer HJP-25005 from Sugino Machine Limited to prepare a PFA dispersion.

Comparative Example 4

The procedures of preparation and evaluation of the electrophotographic photoreceptor in Example 6 were repeated to prepare and evaluate an electrophotographic photoreceptor of Comparative Example 4 except for dispersing with a ball mill using glass beads having a diameter of 1 mm for 48 hrs instead of the high-speed liquid collision disperser Ultimizer HJP-25005 from Sugino Machine Limited to prepare a PFA dispersion.

Comparative Example 5

The procedures of preparation and evaluation of the electrophotographic photoreceptor in Example 1 were repeated to prepare and evaluate an electrophotographic photoreceptor of Comparative Example 5 except for not insonifying the coating liquid after dispersed with the high-speed liquid collision disperser Ultimizer HJP-25005 from Sugino Machine Limited to prepare a protective coating liquid.

Comparative Example 6

The procedures of preparation and evaluation of the electrophotographic photoreceptor in Example 1 were repeated to prepare and evaluate an electrophotographic photoreceptor of Comparative Example 6 except for coating the protective layer coating liquid on the CTL with the spray gun at an air pressure of 1 kgf/cm$^2$ for four times.

The evaluation results are shown in Tables 1-1 and 1-2.

TABLE 1-1

| | Volume ratio (% by volume) | S1 (%) | S2 (%) | Abrasion amount (μm) |
|---|---|---|---|---|
| Example 1 | 34 | 25 | 20 | 1.2 |
| Example 2 | 22 | 17 | 15 | 1.7 |
| Example 3 | 62 | 34 | 30 | 1.5 |
| Example 4 | 34 | 14 | 10 | 1.4 |
| Example 5 | 34 | 22 | 17 | 1.2 |
| Example 6 | 34 | 23 | 20 | 1.3 |
| Example 7 | 34 | 19 | 17 | 1.4 |
| Comparative Example 1 | 34 | 9 | 7 | 2.4 |
| Comparative Example 2 | 22 | 7 | 4 | 3.3 |
| Comparative Example 3 | 62 | 6 | 4 | 2.7 |
| Comparative Example 4 | 34 | 8 | 6 | 2.2 |
| Comparative Example 5 | 34 | 8 | 6 | 2.2 |
| Comparative Example 6 | 34 | 8 | 6 | 2.8 |

TABLE 1-2

| | Initial background fouling | Background fouling after 50,000 images were produced | Other irregularities |
|---|---|---|---|
| Example 1 | 5 | 5 | None |
| Example 2 | 5 | 4 | None |
| Example 3 | 5 | 5 | None |
| Example 4 | 5 | 4 | Slightly poor granularity, but no problem in practical use |
| Example 5 | 5 | 5 | None |
| Example 6 | 5 | 5 | None |
| Example 7 | 5 | 4 | None |
| Comparative Example 1 | 5 | 2 | Poor halftone dot reproducibility |
| Comparative Example 2 | 5 | 1 | Poor halftone granularity |
| Comparative Example 3 | 5 | 2 | Poor halftone dot reproducibility |
| Comparative Example 4 | 5 | 2 | Poor halftone dot reproducibility |
| Comparative Example 5 | 5 | 2 | Poor halftone granularity |
| Comparative Example 6 | 5 | 2 | Black spots are seen due to defective coated layer |

Examples 8 to 10 and Comparative Examples 7 to 9

The procedures for evaluation of electrophotographic photoreceptors of Examples 1 to 3 and Comparative Examples 1 to 3 were repeated to evaluate electrophotographic photoreceptors of Examples 8 to 10 and Comparative Examples 7 to 9 except for using a modified full-color laser printer Imagio Color 8100 from Ricoh Company, Ltd., wherein a cleaning blade contact pressure to the electrophotographic photoreceptor and gap between an image developer and the electrophotographic photoreceptor were adjusted to increase a load to an abrasion thereof.

The evaluation results are shown in Table 2-1 and 2-2.

TABLE 2-1

| | Volume ratio (% by volume) | S1 (%) | S2 (%) | Abrasion amount (μm) |
|---|---|---|---|---|
| Example 8 | 34 | 25 | 20 | 2.4 |
| Example 9 | 22 | 17 | 15 | 3.3 |
| Example 10 | 62 | 34 | 30 | 2.9 |
| Comparative Example 7 | 34 | 9 | 7 | 4.9 |
| Comparative Example 8 | 22 | 7 | 4 | 6.2 |
| Comparative Example 9 | 62 | 6 | 4 | 5.2 |

TABLE 2-2

| | Initial background fouling | Background fouling after 50,000 images were produced | Other irregularities |
|---|---|---|---|
| Example 8 | 5 | 5 | None |
| Example 9 | 5 | 4 | None |
| Example 10 | 5 | 5 | None |
| Comparative Example 7 | 5 | 2 | Poor halftone dot reproducibility |
| Comparative Example 8 | 5 | 1 | Poor halftone granularity |
| Comparative Example 9 | 5 | 1 | Poor halftone dot reproducibility |

Examples 11 to 13 and Comparative Examples 10 to 12

The procedures for evaluation of electrophotographic photoreceptors of Examples 1 to 3 and Comparative Examples 1 to 3 were repeated to evaluate electrophotographic photoreceptors of Examples 11 to 13 and Comparative Examples 10 to 12 except for using a full-color copier having the image forming engine in FIG. 8 and a printing speed of 60 pieces (vertical A4)/min.

The evaluation results are shown in Table 3-1 and 3-2.

TABLE 3-1

| | Volume ratio (% by volume) | S1 (%) | S2 (%) | Abrasion amount (μm) |
|---|---|---|---|---|
| Example 11 | 34 | 25 | 20 | 2.2 |
| Example 12 | 22 | 17 | 15 | 3.0 |
| Example 13 | 62 | 34 | 30 | 2.5 |
| Comparative Example 10 | 34 | 9 | 7 | 4.8 |
| Comparative Example 11 | 22 | 7 | 4 | 6.0 |
| Comparative Example 12 | 62 | 6 | 4 | 5.2 |

TABLE 3-2

| | Initial background fouling | Background fouling after 50,000 images were produced | Other irregularities |
|---|---|---|---|
| Example 11 | 5 | 5 | None |
| Example 12 | 5 | 4 | None |
| Example 13 | 5 | 5 | None |

TABLE 3-2-continued

| | Initial background fouling | Background fouling after 50,000 images were produced | Other irregularities |
|---|---|---|---|
| Comparative Example 10 | 5 | 2 | Poor halftone dot reproducibility |
| Comparative Example 11 | 5 | 1 | Poor halftone granularity |
| Comparative Example 12 | 5 | 2 | Poor halftone dot reproducibility |

This document claims priority and contains subject matter related to Japanese Patent Applications Nos. 2003-198801 and 2003-202507 filed on Jul. 17, 2003, and Jul. 28, 2003, respectively, which are incorporated herein by reference.

Having now fully described the invention, it will be apparent to one of ordinary skill in the art that many changes and modifications can be made thereto without departing from the spirit and scope of the invention as set forth herein.

What is claimed as new and desired to be secured by Letters Patent of the United States is:

1. An electrophotographic photoreceptor, comprising:

an electroconductive substrate; and a photosensitive layer overlying the electroconductive substrate, wherein an outermost layer of the electrophotographic photoreceptor comprises a particulate fluorine-containing resin; and a primary particle of the particulate fluorine-containing resin and a secondary particle formed of agglomerated primary particles thereof, which are projected from a surface of the outermost layer, together have an average particle diameter of from 0.15 to 3 μm and are present in an area ratio not less than 10%, based on a total surface area of the outermost layer.

2. The electrophotographic photoreceptor of claim 1, wherein the area ratio of the primary particle of the particulate fluorine-containing resin and the secondary particle, which together have an average particle diameter of from 0.2 to 1.5 μm, is from 10% to 60%.

3. The electrophotographic photoreceptor of claim 1, wherein the outermost layer comprises a particulate fluorine-containing resin in an amount of 20% to 60% by volume.

4. The electrophotographic photoreceptor of claim 1, wherein the photosensitive layer comprises:

a first layer comprising a charge generation material and a charge transport material; and a protective layer overlying the first layer, wherein the protective layer is the outermost layer and comprises a binder resin and a particulate fluorine-containing resin.

5. The electrophotographic photoreceptor of claim 1, wherein the outermost layer further comprises a charge transport material.

6. An image forming apparatus, comprising:

a unit comprising:

the electrophotographic photoreceptor of claim 1;

a charger configured to charge the electrophotographic photoreceptor;

an image developer configured to develop an electrostatic latent image, with a developer comprising a toner, to form a toner image on the electrophotographic photoreceptor; and a transferer configured to transfer the toner image onto a transfer sheet;

an irradiator configured to irradiate the electrophotographic photoreceptor to form the electrostatic latent image thereon; and a fixer configured to fix the toner image on the transfer sheet.

7. The image forming apparatus of claim 6, further comprising a contact member configured to frictionize a surface of the outermost layer while contacting the surface thereof.

8. The image forming apparatus of claim 6, comprising two or more units.

9. The image forming apparatus of claim 6, further comprising:

an intermediate transferer configured to receive the toner image from the electrophotographic photoreceptor to transfer the toner image onto the transfer sheet, wherein the toner image comprises a plurality of color toner images that are transferred onto the transfer sheet at a same time.

10. A process cartridge, comprising:

the electrophotographic photoreceptor of claim 1; and at least one member selected from the group consisting of chargers, irradiators, image developers, transferers, and fixers.

11. An image forming method, comprising:

charging at least one electrophotographic photoreceptor;

irradiating the at least one electrophotographic photoreceptor to form an electrostatic latent image thereon;

developing the electrostatic latent image with a developer comprising a toner to form a toner image on the electrophotographic photoreceptor;

transferring the toner image onto a transfer sheet; and fixing the toner image on the transfer sheet, wherein the at least one electrophotographic photoreceptor comprises the electrophotographic photoreceptor of claim 1.

12. The image forming method of claim 11, further comprising:

frictionizing a surface of the electrophotographic photoreceptor with a contact member while contacting the contact member thereto to form a layer of the particulate fluorine-containing resin thereon.

13. The image forming method of claim 11, further comprising:

charging two or more electrophotographic photoreceptors;

irradiating the two or more electrophotographic photoreceptors to form electrostatic latent images thereon;

developing the electrostatic latent images with respective developers each comprising a color toner to form color toner images on the respective electrophotographic photoreceptors;

transferring the color toner images onto a transfer sheet via an intermediate transferer; and fixing the toner images on the transfer sheet.

* * * * *